United States Patent [19]

Evezich

[11] Patent Number: 4,760,937

[45] Date of Patent: Aug. 2, 1988

[54] SQUEEZABLE DEVICE FOR EJECTING RETAINED MATERIALS

[76] Inventor: Paul D. Evezich, 141 Johnson, Frederick, Colo. 80530

[21] Appl. No.: 874,676

[22] Filed: Jun. 16, 1986

[51] Int. Cl.[4] ..... B65D 35/28

[52] U.S. Cl. ..... 222/95; 222/105; 222/209; 222/212; 222/386.5; 222/568

[58] Field of Search ..... 222/94, 95, 105, 183, 222/211–213, 209, 325, 386.5, 566, 568, 575, 326

[56] References Cited

U.S. PATENT DOCUMENTS

| | | | |
|---|---|---|---|
| 817,054 | 4/1906 | Gay | 222/95 X |
| 1,965,271 | 7/1934 | Wharton | 222/95 |
| 2,714,974 | 8/1955 | Sawyer | 222/94 |
| 2,715,981 | 8/1955 | Moubayed | 222/209 |
| 2,928,533 | 3/1960 | Loucony | 222/575 X |
| 3,039,644 | 6/1962 | Lefcort | 222/80 X |
| 3,118,572 | 1/1964 | Harding | 222/183 |
| 3,172,568 | 3/1965 | Modderno | 222/80 |
| 3,178,060 | 4/1965 | Bossack | 222/105 X |
| 3,203,592 | 8/1965 | Farandatos | 222/5 |
| 3,223,289 | 12/1965 | Bouet | 222/95 X |
| 3,225,967 | 12/1965 | Heimgartner | 222/105 X |
| 3,255,923 | 6/1966 | Soto | 222/80 |
| 3,270,920 | 9/1966 | Nessler | 222/95 |
| 3,306,500 | 2/1967 | Williams | 222/209 |
| 3,342,377 | 9/1967 | Peredy | 222/94 |
| 3,474,936 | 10/1969 | McDonnell | 222/212 X |
| 3,592,365 | 7/1971 | Schwartzman | 222/209 |
| 3,603,484 | 9/1971 | Ogle | 222/94 |
| 3,648,903 | 3/1972 | Marchant | 222/212 |
| 3,656,660 | 4/1972 | Mueller | 222/94 |
| 3,731,844 | 5/1973 | Baker | 222/83 |
| 3,995,772 | 12/1976 | Liautaud | 222/83.5 |
| 4,098,434 | 7/1978 | Uhlig | 222/95 X |
| 4,102,476 | 7/1978 | Loeffler | 222/209 |
| 4,147,278 | 4/1979 | Uhlig | 222/95 X |
| 4,147,306 | 4/1979 | Bennett | 222/212 X |
| 4,154,366 | 5/1979 | Acres | 222/386.5 X |
| 4,159,790 | 7/1979 | Bailey | 222/211 |
| 4,382,530 | 5/1983 | Calisto | 222/326 X |
| 4,469,250 | 9/1984 | Evezich | 222/95 X |

FOREIGN PATENT DOCUMENTS

| | | | |
|---|---|---|---|
| 1255159 | 1/1960 | France | 222/95 |

*Primary Examiner*—Kevin P. Shaver
*Attorney, Agent, or Firm*—Robert E. Harris

[57] ABSTRACT

Apparatus for dispensing fluid materials contained in a readily deformable inner container which is located within a resilient outer container. The inner container and a nozzle are permanently affixed to one another and the nozzle has a first one-way check valve permitting ejection of the contents from the inner container. The resilient outer container has a second one-way valve to admit air from the exterior of the device to the space between the inner and outer containers.

8 Claims, 2 Drawing Sheets

27
39
31
29
21
19
33
25
37
35
23
15
63
49
47
51
45
43
41
53
57
55
65
17
3
61
59

SQUEEZABLE DEVICE FOR EJECTING RETAINED MATERIALS

FIELD OF THE INVENTION

This invention relates to dispensing devices and, more particularly, relates to squeezable dispensing devices for dispensing flowable materials.

BACKGROUND OF THE INVENTION

Squeezable dispensing devices for dispensing flowable materials are well known and such devices have heretofore been developed and/or utilized wherein bladder containment and/or pressure dispensing are shown. One such arrangement, for example, is described in U.S. Pat. No. 3,225,967 issued Dec. 28, 1965 to J. Heimgartner and U.S. Pat. No. 3,270,920 issued Sept. 6, 1966 to C. G. Nessler showing an arrangement where the contents of a bladder are urged therefrom by a supply of gas and which makes use of valves to modulate the expulsion of the contents from the bladder.

Another arrangement making use of a bladder containing materials to be dispensed by pressure is shown in U.S. Pat. No. 4,469,250 issued Sept. 4, 1984 to Evezich (the Applicant herein). In this arrangement a separate bladder is housed within a squeezable outer shell having a removable cap and nozzle construction and requiring a projection positioned at the base of the nozzle for piercing the bladder to allow dispensing of its contents, the various elements not being permanently affixed to one another.

Thus, while squeezable dispensing devices making use of bladders and/or pressure dispensing have heretofore been suggested and/or utilized, further improvements could nevertheless still be utilized.

SUMMARY OF THE INVENTION

This invention provides an improved dispensing device for dispensing flowable materials, for example. Dispensing of materials is achieved through use of a deformable inner container housed within a resilient outer container, the inner container containing the material to be dispensed and communicating with the exterior of the device through a nozzle permanently affixed to the inner container and having a one-way check valve positioned to permit flow of the contents of the inner container therethrough but precluding passage of matter into the inner container. A second one-way check valve is positioned to permit the flow of air from the exterior of the device to the volume defined between the inner container and outer container.

It is therefore an object of this invention to provide an improved dispensing device for dispensing flowable materials.

It is another object of this invention to provide an improved dispensing device for dispensing flowable materials which has a deformable inner container and in which the contents of the inner container are substantially protected from contaminants.

It is still another object of this invention to provide an improved dispensing device for dispensing flowable materials, the device being entirely disposable.

It is yet another object of this invention to provide an improved dispensing device for dispensing flowable materials having a disposable inner container and nozzle portion and a reusable outer container.

It is still another object of this invention to provide an improved dispensing device for dispensing flowable materials having a reusable, resilient outer container formed of a container portion and a retaining ring portion engagable with the container portion for containing a disposable inner container and nozzle.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate complete embodiments of the invention according to the best mode so far devised for the practical application of the principles thereof, and in which.

DESCRIPTION OF THE INVENTION

Figures 1, 2, 3, 4, 5:
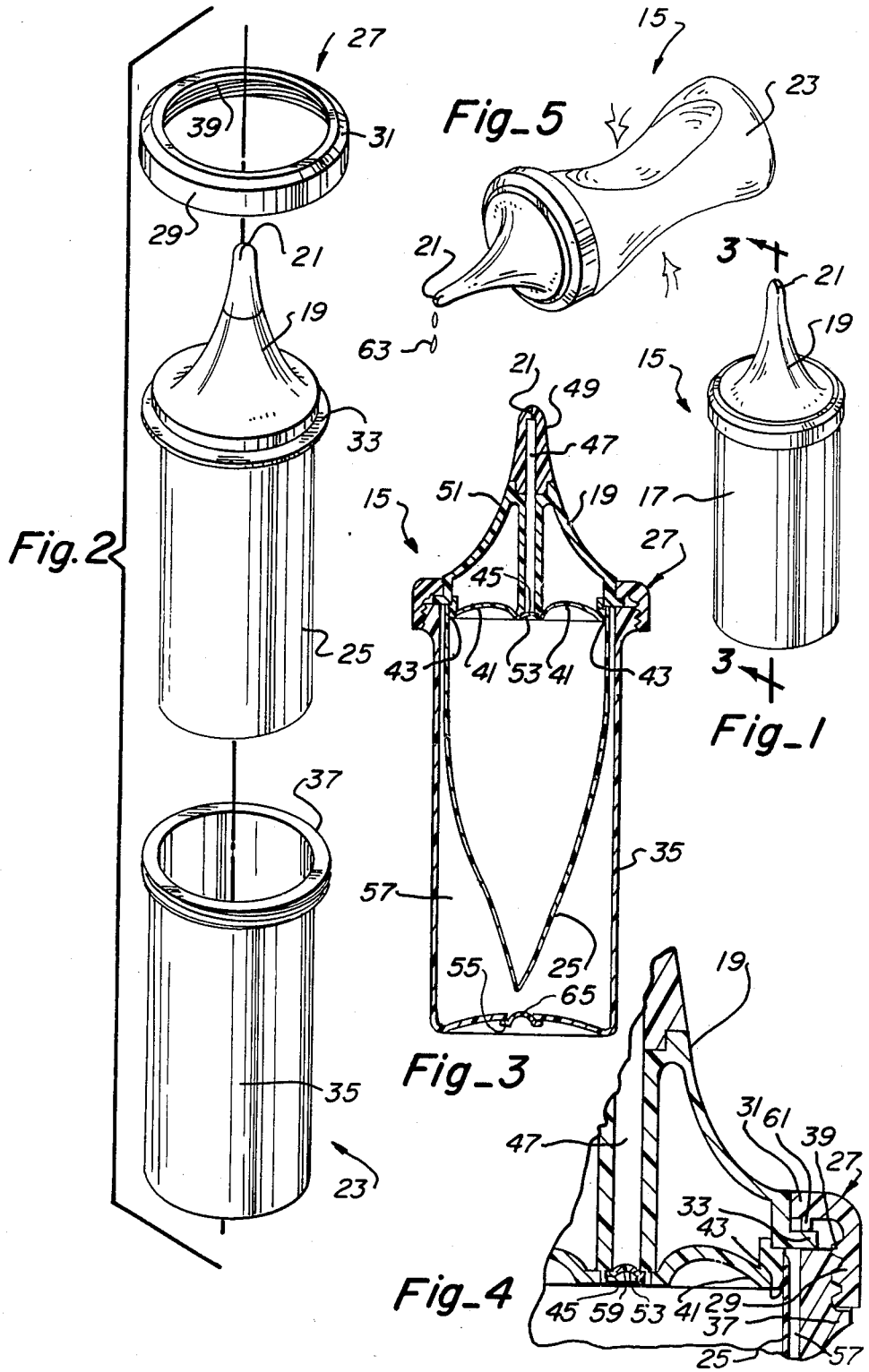
FIG. 1 is a perspective view of a first embodiment of the dispensing device of this invention.
FIG. 2 is a partially exploded perspective view of the dispensing device of FIG. 1.
FIG. 3 is a sectional view of the device of FIG. 1 taken along section line 3—3.
FIG. 4 is a partial sectional view of the device of FIG. 3 particularly illustrating the relationship of the two component external container.
FIG. 5 is a perspective view of the device of FIG. 1 showing material being dispensed.

Referring now to the drawings, a storage and dispensing device 15 for storing and dispensing materials is shown in FIG. 1. As shown, dispensing device 15 includes body 17 and dispensing conduit, or nozzle, 19 having an outlet terminus 21.

As best shown in FIG. 2, dispensing device 15 includes three components, a resilient outer container 23, a deformable inner container 25, and a retainer ring 27 engagable with resilient outer container 23. Retainer ring 27 includes a threaded base 29 and a retainer lip 31. The deformable inner container 25 has thereon, at the joinder between the deformable inner container 25 and the nozzle 19, an annular ridge 33. Resilient outer container 23, in turn, includes inner container housing 35 having external threads 37 at the upper portion or body section thereof, the external threads 37 being engagable with internal threads 39 of the retainer ring, thereby maintaining the deformable inner container 25 within the resilient outer container 23 by clamping of annular ridge 33 between retainer lip 31 and housing 35, and maintaining nozzle 19 through retainer ring 27.

As best shown in FIG. 3, dispensing device 15 includes curved nozzle base 41, which base is curved toward the inner portions of nozzle 19, and which, together with deformable inner container 25 provides a storage area for the materials to be dispensed. Deformable inner container 25 is permanently affixed, or joined, to nozzle 19, and, more particularly, is permanently connected with the curved nozzle base 41 at joinder 43 which defines the outer circumference of the curved nozzle base 41. Inlet terminus 45 defines an inner circumference of curved nozzle base 41, inlet terminus 45 opening to dispensing channel 47 and outlet terminus 21 through nozzle 19.

Nozzle 19 includes two sections, nozzle tip 49, and nozzle body 51. At inlet terminus 45, one-way valve 53 (which may be any of a variety of one-way valves known commercially) is disposed allowing passage of materials from deformable inner container 25 to dispensing channel 47, while substantially precluding movement of matter from the dispensing channel 47 back into the inner container 25.

At the bottom portions of inner container housing 35, a second one-way valve 55 (which may also be any of a variety of one-way valves known commercially) is located, which valve allows passage of air from the exterior of the dispensing device to the volume 57 defined between inner container housing 35 and inner container 25. Valve 55 substantially precludes passage of air from volume 57 to the exterior of the dispensing device.

Turning now to FIG. 4, details of the two part outer container and one-way valving are shown. Valve 53 is shown, for example, to be a curved valve positioned at inlet terminus 45. While curved in its cross-section, valve 53 is more accurately viewed as a dome-shaped valve having its convex portion facing into dispensing channel 47 and its concave portion being presented to the interior of deformable inner container 25. Valve 53 is constructed, for example, of a resilient material having negligible resilience to stresses imposed against its convex surface but being resilient with regard to stresses imposed on its concave surface. Passageway 59 in valve 53 opens in response to stresses to the convex surface to allow passage of materials from the inner container 25 to dispensing channel 47 and thereafter through outlet terminus 21, such stress being created by application of pressure to the inner container 25, for example, by the squeezing of outer container 23.

As also shown in FIG. 4, retainer ring 27 is engagable at internal threads 39 by external threads 37 of resilient outer container 23. Retainer lip 31 brings annular clamping projection 61 to bear upon annular ridge 33 thereby clamping the annular ridge between the clamping projection 61 and the upper surface of external threads 37 and sealing volume 57 at its upper extremity.

It may be seen, therefore, that when resilient outer container 23 is depressed, as shown in FIG. 5, material 63 is forced through outlet terminus 21 as air within volume 57 creates pressure on the inner container 25. When inner container 25 is thus compressed, materials are forced through one-way valve 53 and into dispensing channel 47 and ultimately through outlet terminus 21. Upon release of the resilient outer container 23, the outer container begins to return to its original shape thereby relieving the pressure on inner container 25 and allowing passageway 59 in valve 53 to close. However, deformable inner container 25 stays in its deformed shape as no air or other matter is allowed to pass back through valve 53 and occupy any volume thereof. As resilient outer container 23 regains its shape it draws air through one-way valve 55 from the exterior of the device through opening 65 into the volume 57. When the outer container 23 has fully regained its shape, the pressure between the volume 57 and the exterior of the device will equalize thus allowing the opening 65 in valve 55 to close, thereby disallowing passage of air back from the volume 57 to the exterior of the device. When all of this has occurred, the process may be repeated, the volume of air within the resilient outer container 23 thus being sufficiently replenished to continually apply pressure to the inner container 25 until the inner container is substantially completely deformed and emptied of its contents.

Curved nozzle base 41 is configured so that a cone in the deformable inner container 25 is not formed as would be the case if the nozzle base were flat, thereby allowing the deformable inner container 25 to enter into the volume of the convex curvature of curved nozzle base 41 for a more complete evacuation of the contents within the inner container 25.

Figure 6:
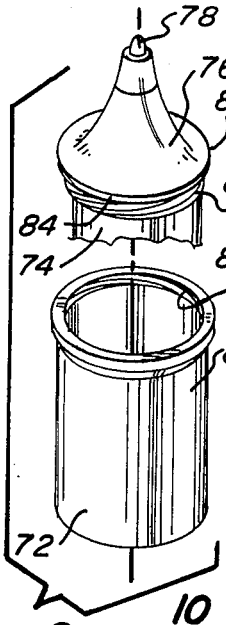
FIG. 6 is a partial, exploded view of a second embodiment of the dispensing device of this invention.

Turning now to FIG. 6, a second embodiment of the dispensing device of this invention is shown. Dispensing device 70 includes a resilient outer container 72 and a deformable inner container 74 which is preferably permanently joined with nozzle 76. Nozzle 76 may be identical in structure to that of nozzle 19 above-described, and includes outlet terminus 78 and base 80, base 80 having external threads 82 positioned below a sealing ridge 84. Outer container 72 includes inner container housing 86 having internal threads 88 at the upper portion thereof, the internal threads 88 and the external threads 82 of nozzle 76 being engagable.

Figure 7:
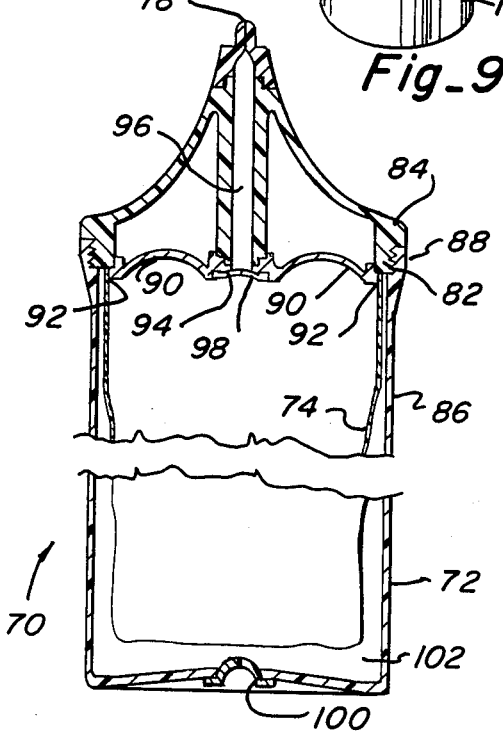
FIG. 7 is a partial sectional view of the embodiment of the device shown in FIG. 6.

In FIG. 7 it shall be seen that the alternative embodiment of the dispensing device 70 has many of the features of the dispensing device shown in FIG. 3. Curved nozzle base 90 is shown which, together with the inner container 74 preferably permanently joined at joinder 92, forms the storage area for the materials. Base 90 has inlet terminus 94 at its inner circumference leading to dispensing channel 96 through one-way valve 98. At the bottom portion of the resilient outer container 72, one-way valve 100 is disposed for the passage of air from the exterior of the device to the volume 102 defined between the outer container 72 and the inner container 74. The dispensing device operates in the same manner as the previous embodiment, with the exception that nozzle 76 and inner container 74 form a unitary structure thereby providing a two-part construction for the dispensing device engagable at external threads 82 of nozzle base 80 and internal threads 88 at the upper portion of resilient outer container 72, the two portions when tightly engaged bringing annular sealing ridge 84 into a substantially sealing relationship with the upper portion of the internal threads 88 of outer container 72 thereby sealing volume 102 thereat.

Figure 8:
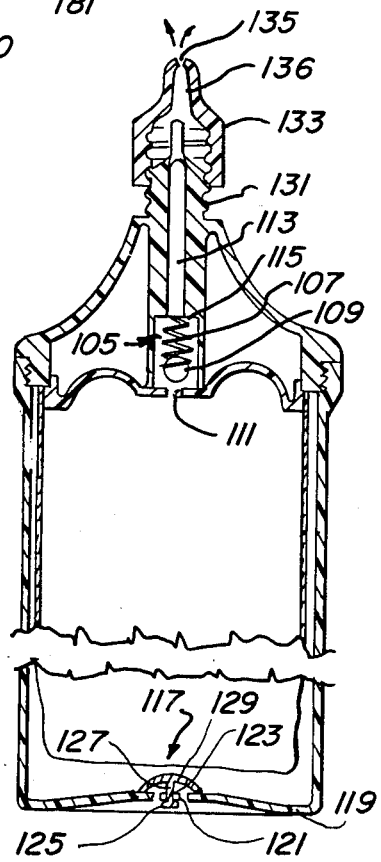
FIG. 8 is a partial sectional view of a third embodiment of the dispensing device of this invention and particularly illustrating one alternative nozzle and valving.

In FIG. 8 a third embodiment of the dispensing device of this invention is shown, in many ways similar to the device shown in FIG. 7, but showing alternative one-way valving and selective dispensing channel closure. Turning first to the alternative one-way valving, one-way valve 105 is shown to include spring 107 and stopper 109, spring 107, at one end thereof, biasing stopper 109 toward inlet terminus 111 to dispensing channel 113, and spring 107 at its other end resting against support surface 115. When materials are being urged through inlet terminus 111, stopper 109 is forced away from inlet terminus 111 to dispensing channel 113 thereby allowing passage of materials, but when material flow ceases, spring 107 urges stopper 109 back into a sealing relationship with inlet terminus 111 thereby preventing the movement of air and matter from dispensing channel 113 through inlet terminus 111.

A second alternative one-way valve 117, is shown at the lower portion of the alternative embodiment shown in FIG. 8. Valve 117 is positioned in resilient outer container 119, at air inlet 121, through mounting hole 123 being held in place by retainer 125 at the exterior of the dispensing device. Retainer 125 is connected to valve flaps 129 by connector 127. As resilient outer container 119 begins to regain its shape after deformation, and air is drawn through air inlet 121 from the exterior of the device, valve flaps 129 are forced open thereby allowing the passage of air into the device until the pressure is equalized, whereupon the valve flaps 129 are closed.

Also shown in FIG. 8, threaded nozzle tip 131 is provided for receipt of threaded cap 133, threaded nozzle tip 131 and threaded cap 133 together providing outlet terminus 135. Outlet terminus 135 is normally closed where no stresses are imposed on inner walls 136 of threaded cap 133. However, when threaded cap 133 is tightened against threaded nozzle tip 131, normally closed outlet terminus 135 is forced into its open position thereby allowing materials to escape from the dispensing device.

Figure 9:
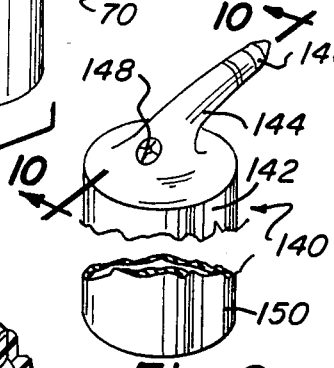
FIG. 9 is a partial perspective view of a fourth embodiment of the dispensing device of this invention.

Turning to FIG. 9, a fourth embodiment of the dispensing device is shown, 140, the device having a one-piece resilient body 142 having a nozzle 144 closed by removable sealing cap 146. Resilient body 142 includes one-way valve 148 at the upper portion thereof for selectively allowing passage of air from the exterior of the dispensing device 140 to interior portions thereof.

Figure 10:
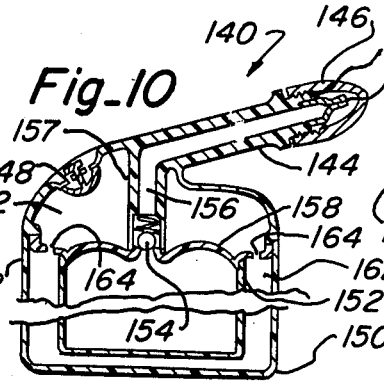
FIG. 10 is a partial sectional view of the embodiment of the device of FIG. 9 taken along section line 10—10.

As shown in FIG. 10, it may be appreciated that this one-piece construction of the dispensing device is similar in many regards to the prior embodiments shown herein. Body 142 is shown to include resilient outer container 150, as well as nozzle 144 and deformable inner container 152 having one-way valve 154 (similar to the valving shown in FIG. 8 for example) at the inlet terminus of dispensing channel 156. Dispensing channel inner walls 157 are joined with curved nozzle base 158 which in turn is joined with the deformable inner container 152. Removable sealing cap 146 covers outlet terminus 159 of nozzle 144, being engagable at threaded nozzle tip 160. In this embodiment, the volume 162 defined between the resilient outer container 150 and deformable inner container 152 is shown to extent into portions of nozzle 144 through annular opening 164, thereby allowing placement of one-way valve 148 at the upper portion of the dispensing device, for passage of air from the exterior of the device into the volume 162.

Figure 11:
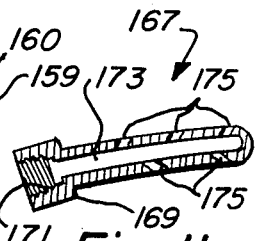
FIG. 11 is a sectional view of one available auxiliary attachment usable with the dispensing device of this invention.

In FIG. 11 one of many auxiliary attachments usable with the dispensing device is shown. Nozzle extender 167 includes nozzle engaging base 169 having internal threads 171 therein for attachment of the nozzle extender to, for example, threaded nozzle tip 131 (shown in FIG. 8) or threaded nozzle tip 160 (shown in FIG. 10). Dispensing channel extension 173 resides through the nozzle extender 167 and has multiple outlet termini 175.

Figure 12:
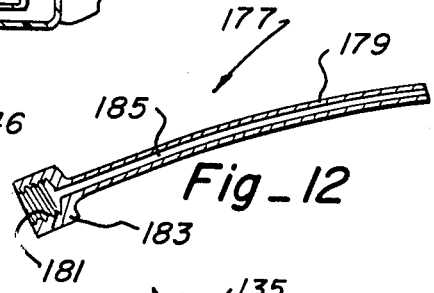
FIG. 12 is a sectional view of a second auxiliary attachment usable with the dispensing device of this invention.

In FIG. 12 a second nozzle extender 177 is shown. Herein a resilient nozzle 179 is shown with internal threads 181 at the base 183 thereof and having dispenser channel extension 185 therethrough.

A variety of materials may be used in constructing the dispensing device of this invention. The construction of the device may include one, two, three or more components thereby allowing for selective disposability and/or reuse of all or portions of the dispensing device, the nozzle and inner container being permanently affixed in all cases. Additionally, a more complete evacuation of the contents of the inner container portions may be achieved through use of the curved nozzle base (though it is to be realized that this configuration is not the only configuration available), and the materials within the inner containment area may be protected from contaminants by use of the one-way valving within the dispensing channel. Nozzle extenders of many and varied uses may be constructed for attachment to the dispensing device and the nozzle may be constructed to receive caps for sealing the dispensing channel, thus further preventing contaminants from reaching either the dispensing channel or material to be dispensed from the dispensing device.

In summary, an improved dispensing device for dispensing predetermined, usually non-compressible, materials is shown herein having at least a deformable inner container permanently affixed to a nozzle (which may be of variable design) and housed within a resilient outer container and which makes use of one-way valving positioned to permit ejection of the contents of the inner container through the nozzle but precludes passage of contaminants into the inner container. The nozzle is configured to effect a more complete evacuation of materials from the inner container. A second one-way valving is positioned to admit air from the exterior of the device to a volume defined between the inner container and the outer container, while precluding passage of air from the volume to the exterior of the device, for maintaining a sufficient volume of air between the inner and outer containers to allow continued evacuation of the contents of the inner container when pressure is applied to the outer container without regard to the position of the device or volume of content remaining in the device.

What is claimed is:

1. A device for dispensing a predetermined material comprising:

a readily deformable inner containment portion having a closed end and an open end for containing said material to be dispensed and a dispensing channel portion having a first one-way valve therein oriented to allow dispensing of said material from said inner containment portion but substantially precluding passage of matter into said inner containment portion through said dispensing conduit portion, said dispensing channel portion including an inlet terminus and a base section, said inlet terminus having said first one-way valve positioned thereat and defining an inner circumference of said base section, and said base section having an outer circumference in a spaced relationship from said inner circumference, the area between said inner circumference and said outer circumference defining a curved surface therebetween extending away from said closed end of said inner containment portion, said inner containment portion adjacent said open end and said dispensing channel portion being permanently affixed at said outer circumference of said base section of said dispensing channel portion; and a resilient outer containment portion and a nozzle said resilient outer containment portion for receiving and containing said inner containment portion without direct attachment of said readily deformable inner containment portion and said resilient outer containment portion, said dispensing channel portion and said nozzle being permanently affixed to one another, said resilient outer containment portion including a second one-way valve positioned to permit flow of matter from the exterior of said outer containment portion to the volume defined between said outer containment portion and said inner containment portion but substantially precluding passage of matter from said volume to the exterior of said outer containment portion.

2. The device for dispensing material of claim 1 wherein said inner containment portion, said dispensing channel portion, and said outer containment portion are permanently affixed to provide a unitary structure.

3. The device for dispensing material of claim 1 wherein at least said first one-way valve comprises flapper valve.

4. The device for dispensing material of claim 1 wherein said outer containment portion includes a body portion and wherein said nozzle and said body portion have opposed engagable surfaces comprising an outwardly facing engaging surface on said nozzle and an inwardly facing engaging surface on said body portion of said outer containment portion.

5. The device for dispensing material of claim 1 wherein said nozzle includes a cap means for selectively disenabling passage of said material from said dispensing channel portion.

6. The device for dispensing material of claim 1 said nozzle further comprising a nozzle extender for.

7. The device for dispensing material of claim 16 wherein said resilient outer containment portion includes a body section and a retainer ring section engagable with said body section, and wherein said nozzle is maintained near said engagement of said ring section.

8. The device for dispensing material of claim 7 wherein said nozzle includes an annular ridge for engaging said body section, and wherein said body section and said retainer ring section have opposed engagable surfaces whereupon engagement of said opposed surfaces said annular ridge is clamped between said body section and said ring section.

* * * * *

UNITED STATES PATENT AND TRADEMARK OFFICE

CERTIFICATE OF CORRECTION

PATENT NO. : 4,760,937

DATED : August 2, 1988

INVENTOR(S) : Evezich

It is certified that error appears in the above-identified patent and that said Letters Patent is hereby corrected as shown below:

Claim 6, line 2, --said nozzle-- was omitted after "for".

Claim 7, line 1, "16" should be --1--.

Signed and Sealed this

Tenth Day of January, 1989

*Attest:*

DONALD J. QUIGG

*Attesting Officer*

*Commissioner of Patents and Trademarks*